US012091821B2

(12) United States Patent
Chen et al.

(10) Patent No.: US 12,091,821 B2
(45) **Date of Patent: *Sep. 17, 2024**

(54) PULP MOLDING NEGATIVE ANGLE CONTAINER AND ITS PROCESSING METHOD

(71) Applicant: BE GREEN INTERNATIONAL, LLC, Lake Barrington, IL (US)

(72) Inventors: Shu Chen, Long Grove, IL (US); Ji Tong, Xuzhou (CN); Zhijia Liu, Xuzhou (CN)

(73) Assignee: BE GREEN INTERNATIONAL, LLC, Lake Barrington, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/900,961

(22) Filed: Sep. 1, 2022

(65) Prior Publication Data

US 2022/0412013 A1 Dec. 29, 2022

Related U.S. Application Data

(60) Continuation of application No. 16/895,117, filed on Jun. 8, 2020, now Pat. No. 11,459,705, which is a (Continued)

(51) Int. Cl.
*D21J 3/10* (2006.01)

(52) U.S. Cl.
CPC ..... *D21J 3/10* (2013.01)

(58) Field of Classification Search
CPC ..... D21J 3/10; D21J 7/00; Y10S 425/014; B29C 45/2608; B29C 45/261
See application file for complete search history.

(56) References Cited

U.S. PATENT DOCUMENTS 6,576,089 B1 6/2003 Sato
10,556,728 B2 * 2/2020 Saito ..... B65D 83/06
(Continued)

FOREIGN PATENT DOCUMENTS

CN 1423719 A 6/2003
CN 202184535 U 4/2012
(Continued)

OTHER PUBLICATIONS

U.S. Patent and Trademark Office, Non-Final Office Action, U.S. Appl. No. 16/895,117, 7 pages, Dec. 8, 2021.
U.S. Patent and Trademark Office, Notice of Allowance, U.S. Appl. No. 16/895,117, 7 pages, May 31, 2022.
U.S. Patent and Trademark Office, Non-Final Office Action, U.S. Appl. No. 15/844,556, 8 pages, Sep. 19, 2019.
(Continued)

*Primary Examiner* — Jose A Fortuna
(74) *Attorney, Agent, or Firm* — Benesch Friedlander Coplan & Aronoff LLP

(57) ABSTRACT

A pulp molding container includes a conical pulp container open at an upper end. An inner wall of the open end of the pulp container has a separation space defined therein which is inclined downwards and set outwards. A protruding shoulder is defined on an outer wall of the open end of the pulp container, wherein the outer diameter of the protruding shoulder is larger than the inner diameter of the hole on the open end. When two pulp containers are nested over each other, the protruding shoulder of the upper container rests on the upper hole of the open end of the lower container, and a separation gap is formed between the separation space of the lower pulp container and an outer wall on the upper pulp container.

12 Claims, 5 Drawing Sheets

Related U.S. Application Data division of application No. 15/844,556, filed on Dec. 17, 2017, now Pat. No. 10,676,872.

(56) References Cited

U.S. PATENT DOCUMENTS

| | | | | |
|---|---|---|---|---|
| 10,676,872 | B2 * | 6/2020 | Chen | D21J 3/10 |
| 11,459,705 | B2 * | 10/2022 | Chen | D21J 3/10 |
| 2003/0111201 | A1 | 6/2003 | Sato | |
| 2004/0084166 | A1 | 5/2004 | Nonomura | |
| 2006/0131788 | A1 | 6/2006 | Takigawa | |
| 2018/0002079 | A1 * | 1/2018 | Saito | B65D 47/14 |
| 2019/0010663 | A1 | 1/2019 | Chen | |
| 2020/0299904 | A1 * | 9/2020 | Chen | D21J 3/10 |
| 2022/0412013 | A1 * | 12/2022 | Chen | D21J 3/10 |
| 2023/0226741 | A1 * | 7/2023 | Khan | B65D 1/0215 215/12.2 |

FOREIGN PATENT DOCUMENTS

| | | | | | |
|---|---|---|---|---|---|
| CN | 107386014 | A | | 11/2017 | |
| CN | 20685957 | U | | 1/2018 | |
| CN | 206858957 | U | * | 1/2018 | D21J 3/10 |
| EP | 1285994 | A1 | | 2/2003 | |
| EP | 1074657 | A4 | | 1/2006 | |
| WO | 03/014471 | A1 | | 2/2003 | |
| WO | 2010/124300 | A1 | | 10/2010 | |

OTHER PUBLICATIONS

U.S. Patent and Trademark Office, Final Office Action, U.S. Appl. No. 15/844,556, 6 pages, Feb. 12, 2020.

U.S. Patent and Trademark Office, Notice of Allowance, U.S. Appl. No. 15/844,556, 7 pages, Apr. 1, 2020.

* cited by examiner

PULP MOLDING NEGATIVE ANGLE CONTAINER AND ITS PROCESSING METHOD

TECHNICAL FIELD

The present disclosure relates to the technical field of pulp containers, and more particularly, to a pulp molding negative angle container and a processing method thereof.

BACKGROUND

Pulp molding containers include industrial pulp molding containers and food pulp molding containers.

The current structure of the pulp molding container is that: its upper end has a conical container with an open end and wall thickness of the conical container are the same. When at least two conical containers are overlapped or nested with each other and then the conical containers are separated one by one, it takes a lot of effort to be able to detach the two upper and lower adjacent conical containers, that is, it is difficult to separate the existing pulp molding container after being stacked.

In order to solve the above technical problems, many inventors have designed a structure in which a convex rib is provided at the open end of a conical container or a convex rib is provided at the bottom of the conical container, which reduces the difficulty of separation to a certain extent. However, the above problems of the prior art still fail to be completely solved.

Secondly, the Chinese patent application discloses a coffee cup cover made of pulp molding process [Application No.: 201120261714.X], which comprises a top wall of the cup cover and a surrounding wall connected with the top wall, wherein the bottom surface of the top wall of the cup cover is provided with a convex ring which is protruding downwards and can abut the inner sidewall of the coffee cup, the inner sidewall of the cup cover's surrounding wall is provided with an annular convex portion which is protruding inwards and can abut the outer sidewall of the coffee cup. A space is formed between the convex ring and annular convex portion for clamping the wall of the coffee cup. The coffee cup cover can prevent the user from squeezing the coffee cup lid excessively, which results in the deformation of the coffee cup cover and the coffee cup body to overflow the coffee and burn the user. When the user drinks coffee, the user can direct the mouth to the liquid outlet to enjoy coffee. It is more safe, convenient and practical as well as avoids coffee leakage during the process of drinking.

Although the above solution has many advantages, the above solution still fails to completely solve the above technical problems. Therefore, it is desired to develop a pulp container capable of solving the above technical problems.

SUMMARY

It is an object of the present invention to provide a pulp molding negative angle container capable of reducing the difficulty of separation to solve the above problems.

It is an object of the present invention to provide a processing method for a pulp molding negative angle container, which has a simple process and is capable of reducing the difficulty of separation to solve the above problems.

In order to achieve the above objects, the present invention is achieved by the following technical solutions: A pulp molding negative angle molding container comprising a pulp panel and at least one conical pulp container which is open on the upper end being attached to the pulp panel, wherein: the inner wall of the open end of the pulp container has a separation space inclined downwards and set outwards; a protruding shoulder is provided on the outer wall of the open end of the pulp container, wherein the outer diameter of the protruding shoulder is larger than the inner diameter of the hole on the open end; wherein when two pulp containers are nested over each other, the protruding shoulder is placed on the upper hole of the open end and a separation gap is formed between the separation space on one pulp container and the outer wall on the other pulp container.

The separation space provided in combination with the protruding shoulder can play the role of supporting as well as reducing the contact area, and effectively reduce the difficulty of separation, and at the same time, the stability after nesting is also very good and meets the production requirements of the enterprise.

Preferably, the separation space is a conical separation countersink and an inner diameter of the conical separation countersink is larger at the bottom than that on the top, the outer diameter of the protruding shoulder is larger than the inner diameter of the upper hole of the conical separation countersink. The depth of conical separation countersink is 1-5 mm.

Preferably, in the above pulp molding negative angle molding container, at least two separation spaces are provided, showing two symmetrically arranged separation steps, and the outer diameter of the protruding shoulder is larger than the distance between the upper ends of two symmetrically arranged separation steps. The separation steps are of arc shape.

Preferably, in the above pulp molding negative angle molding container, a longitudinal section thickness of the open end of the pulp container increases gradually from bottom to top.

Preferably, in the above pulp molding negative angle molding container, the protruding shoulder is an annular protruding shoulder; an annular conical surface is provided on the outer wall of the protruding shoulder, inclining inwards from top to bottom; or a vertically disposed straight surface is provided on the outer wall of the protruding shoulder.

Preferably, in the above pulp molding negative angle molding container, the axis line of the conical separation countersink coincides with the axis line of the pulp container.

Preferably, in the above pulp molding negative angle molding container, the separation steps are arranged symmetrically to the axis line of the pulp container.

Preferably, in the above pulp molding negative angle molding container, a first included angle is formed between the hole wall of the conical separation countersink and the inner wall of the pulp container, wherein the first included angle is: 0°<the first included angle <180°.

Preferably, in the above pulp molding negative angle molding container, a second included angle is formed between the sidewall of the separation steps of the conical separation countersink and the inner wall of the pulp container, and the second included angle is 0°<the second included angle <180°.

Preferably, in the above pulp molding negative angle molding container, a second included angle is formed between the inner wall of the conical separation countersink and the annular conical surface, and the second included angle is 0°<the second included angle <180°.

Preferably, in the above pulp molding negative angle molding container, the outer edge of the pulp panel has an annular skirt folded upwards.

Preferably, in the above pulp molding negative angle molding container, a third included angle is formed between the inner wall of the conical separation countersink and the straight surface, and the angle of the third included angle is 0°<the third included angle <180°.

Preferably, in the above pulp molding negative angle molding container, the bottom of the inner wall of the pulp container has several circumferentially distributed convex parts protruding inwards, and the bottom of the outer wall of the pulp container has concavity parts corresponding to the convex parts.

A processing method for a pulp molding negative angle molding container comprises the following steps:

A. injection: evenly stirred pulp material is injected into a forming mold with mold cavity and an annular inner mold is provided inside the forming mold; the forming mold is provided with a step on the inner wall of the mold cavity; the outer wall of the annular inner mold has an outer inclined surface which is inclined outwards from lop to bottom; an annular groove body is arranged on the top of the mold cavity of the forming mold; the pulp material is heated and at least one pulp container is obtained finally on the pulp panel through the forming mold and the annular inner mold; an annular skirt is on the outer edge of the pulp panel and is folded upwards and matches with the annular groove body; the inner wall of the open end of the pulp container has a separation space, which matches with the outer inclined surface and is inclined downwards and disposed outwards; the outer wall of the open end of the pulp container is provided with a protruding shoulder which matches with the step;

B. demolding: the pulp container is cooled gradually, while the forming mold is heated and the annular inner mold is cooled; the temperature of the forming mold is higher than that of the annular inner mold; then the forming mold is detached downwards; secondly, air is jetted into the pulp container and the annular skirt forces the airflow to converge into the pulp container to achieve the final demolding, which is, a pulp molding negative angle container is obtained.

Preferably, in the above pulp molding negative angle molding container, the separation space is a conical separation countersink and an inner diameter of the conical separation countersink is larger at the bottom than that on the top, the outer diameter of the protruding shoulder is larger than the inner diameter of the upper hole of the conical separation countersink; or at least two separation spaces are provided, showing two symmetrically arranged separation steps, and the outer diameter of the protruding shoulder is larger than the distance between the upper ends of two symmetrically arranged separation steps.

Compared with the prior art, the advantages of the pulp molding negative angle container and its processing technology are as follows:

1. The separation space provided in combination with the protruding shoulder can play the role of supporting as well as reducing the contact area, and effectively reduce the difficulty of separation, and at the same time, the stability after nesting is also very good and meets the production requirements of the enterprise.

2. The structure is simple and easy to manufacture.

3. The process is simple and can reduce the difficulty of separation.

Figure 1:
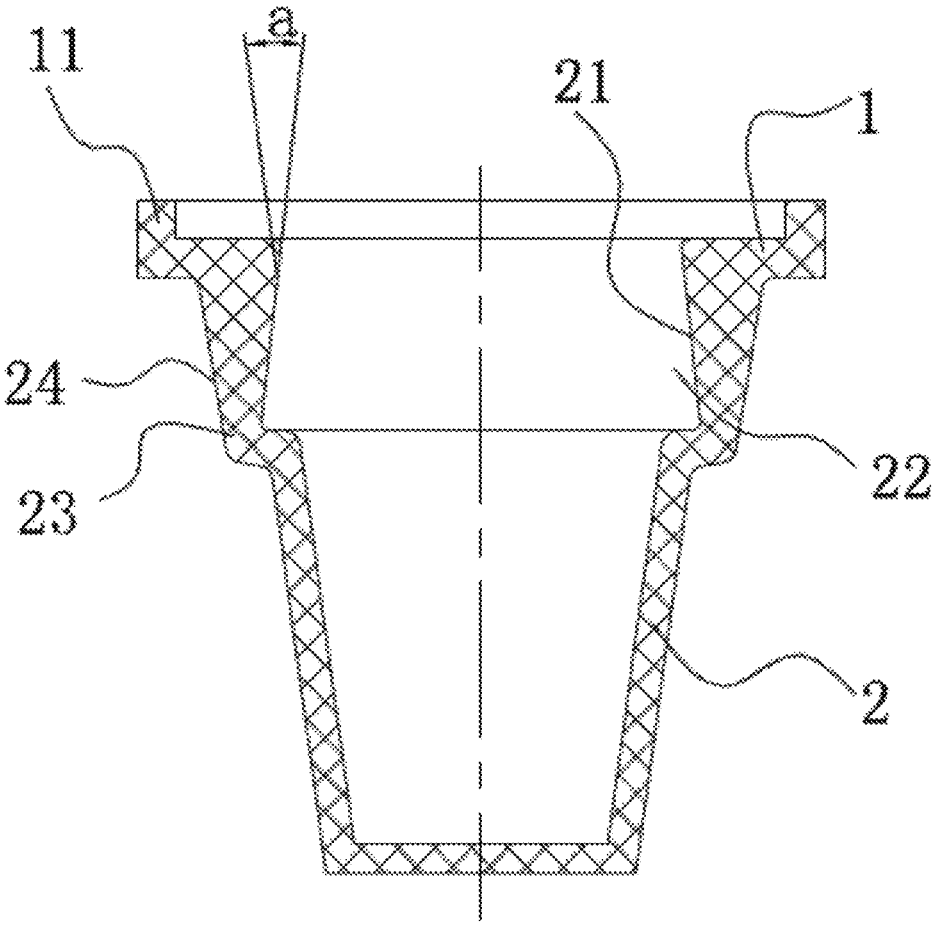
FIG. 1 is a schematic structural diagram of a single pulp container provided by the present invention.

In the Figures: pulp panel 1, annular skirt 11, pulp container 2, open end 21, separation space 22, protruding shoulder 23, annular conical surface 24, straight surface 25, forming mold 3, step 31, annular groove body 32, annular inner mold 4, outer inclined surface 41, first angle a, second angle b.

DETAILED DESCRIPTION

Next, a detailed explanation will be given for exemplary embodiments with reference to the drawings. In the following description of the drawings, a same or like reference sign is given to a same or like part. The drawings schematically represent configurations according to the exemplary embodiments of the present invention. Furthermore, the exemplary embodiments of the present invention described below are examples and may be modified as appropriate as long as the nature of the present invention is not altered.

First Embodiment

Figure 2:
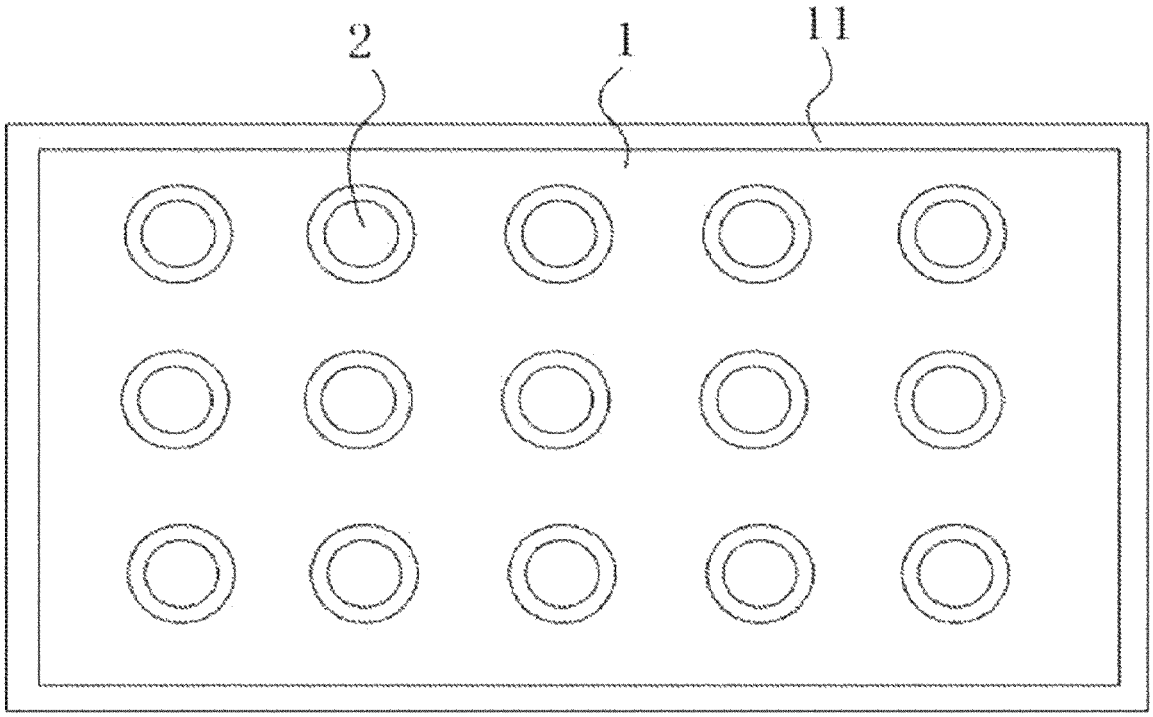
FIG. 2 is a schematic structural diagram of a plurality of pulp containers provided by the present invention.

As shown in FIGS. 1-2, a pulp molding negative angle container according to present invention comprises a pulp panel 1 having an upwardly folded annular skirt 11 at its outer edge.

The annular skirt 11 enables the air flow to converge and seal at the time of demolding, preventing the air flow from running off.

At least one conical pulp container 2 which is open on the upper end is attached to the pulp panel 1. Alternatively, several pulp containers 2 arranged in an array could be connected to the pulp panel 1.

A. single or multiple structures could be produced according to the actual requirements of the production.

Figure 3:
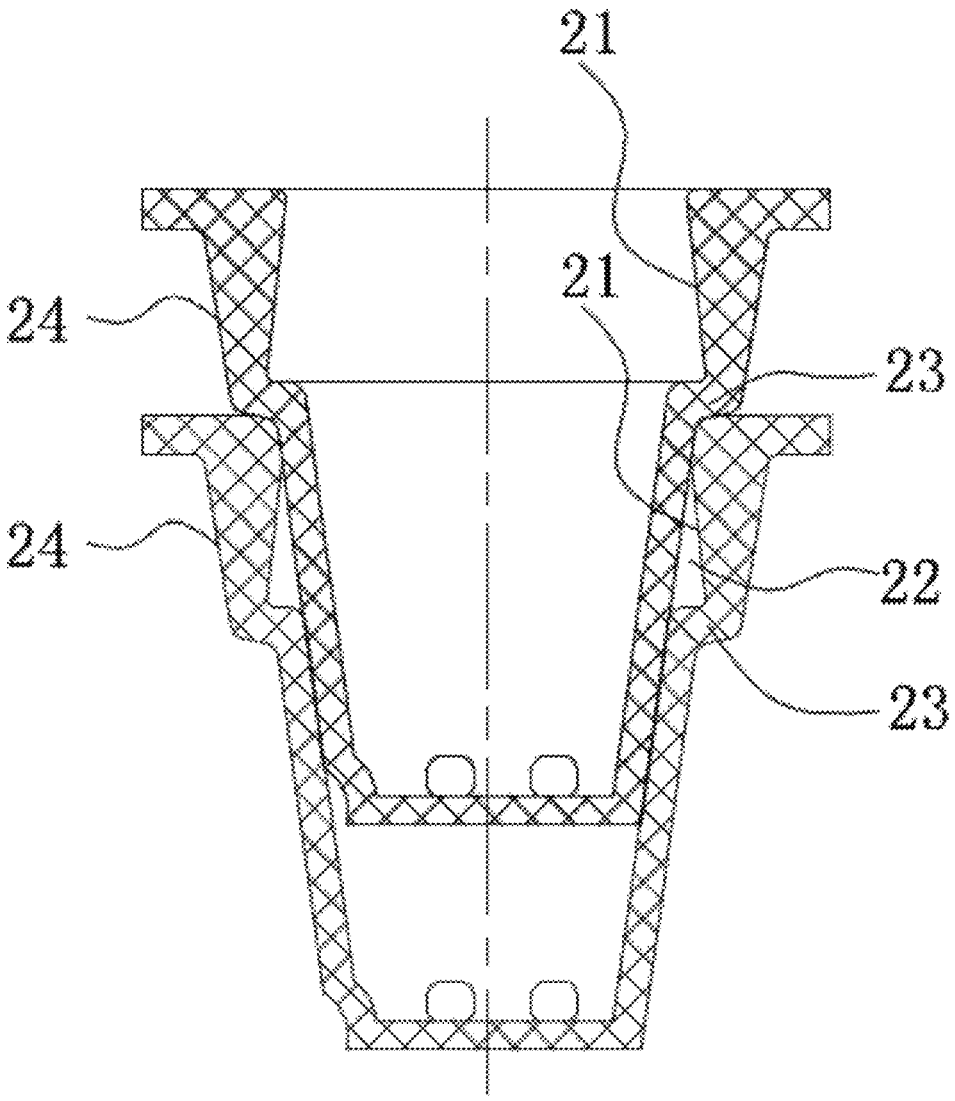
FIG. 3 is a schematic structural diagram of a nesting structure provided by the present invention.
Figure 4:
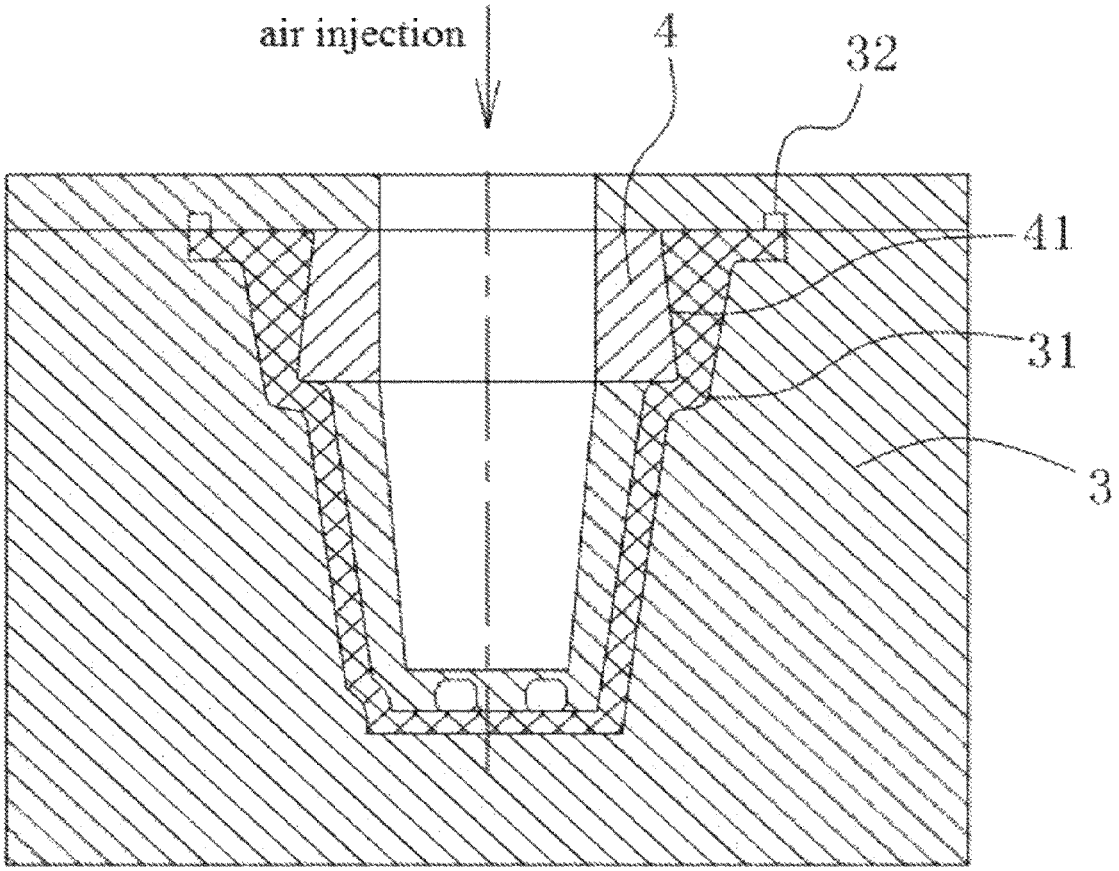
FIG. 4 is a schematic structural diagram of a mold provided by the present invention.

As shown in FIGS. 2-3, the inner wall of the open end 21 of the pulp container 2 has a separation space 22 inclined downwards and set outwards. The separation space 22 in this embodiment is a conical separation countersink and an inner diameter of the conical separation countersink is larger at the bottom than that on the top. The axis line of the conical separation countersink coincides with the axis line of the pulp container 2. For example, the depth of conical separation countersink is 1-5 mm.

A first included angle a is formed between the hole wall of the conical separation countersink and the inner wall of the pulp container 2, and the first included angle a is: 0°<the first included angle a<180° C.

Moreover, a protruding shoulder 23 is provided on the outer wall of the open end of the pulp container 2, and the outer diameter of the protruding shoulder 23 is larger than the inner diameter of the hole on the open end 21. When two pulp containers 2 are nested over each other, the protruding shoulder 23 is placed on the upper hole of the open end 21 and a separation gap is formed between the separation space 22 on one pulp container 2 and the outer wall on the other pulp container 2.

That is, the outer diameter of the protruding shoulder 23 is larger than the inner diameter of the upper hole of the conical separation countersink.

The separation space provided in combination with the protruding shoulder can play the role of supporting as well as reducing the contact area, and effectively reduce the difficulty of separation, and at the same time, the stability after nesting is also very good and meets the production requirements of the enterprise.

In addition, the longitudinal section thickness of the open end of the pulp container 2 increases gradually from bottom to top.

The protruding shoulder 23 of the present embodiment is an annular protruding shoulder. There is an annular conical surface 24 on the outer wall of the protruding shoulder 23, inclining inwards from top to bottom. A third included angle is formed between the hole wall of the conical separation countersink and the annular conical surface 24, and the angle of the third included angle is 0°<the third included angle <180°.

As shown in FIGS. 1-4, the processing technology for the pulp molding negative angle container includes the following steps:

A. Injection: evenly stirred pulp material is injected into a forming mold 3 with mold cavity and an annular inner mold 4 is provided inside the forming mold 3. The forming mold 3 is provided with a step 31 on the inner wall of the mold cavity. The outer wall of the annular inner mold 4 has an outer inclined surface 41 which is inclined outwards from top to bottom. An annular groove body 32 is arranged on the top of the mold cavity of the forming mold 3. The pulp raw material is heated and at least one pulp container is obtained finally on the pulp panel 1 through the forming mold 3 and the annular inner mold 4. There is an annular skirt 11 on the outer edge of the pulp panel 1. The annular skirt 11 is folded upwards and matches with the annular groove body 32. The inner wall of the open end of the pulp container has a separation space 22, which matches with the outer inclined surface 41 and is inclined downwards and disposed outwards. The outer wall of the open end of the pulp container 2 is provided with the protruding shoulder 23 which matches with the step 31.

B. Demolding: the pulp container is cooled gradually, while the forming mold 3 is heated and the annular inner mold 4 is cooled. The temperature of the forming mold 3 is higher than that of the annular inner mold 4. Then the forming mold 3 is detached downwards. Secondly, air is jetted into the pulp container and the annular skirt 11 forces the airflow to converge into the pulp container to achieve the final demolding. That is, a pulp molding negative angle container is obtained.

The forming mold 3 includes a base with a chamber and a cover plate disposed on the base. The step 31 is disposed at the open end of the chamber, and the annular groove body 32 is disposed on the lower surface of the cover plate.

Second Embodiment

Figure 5:
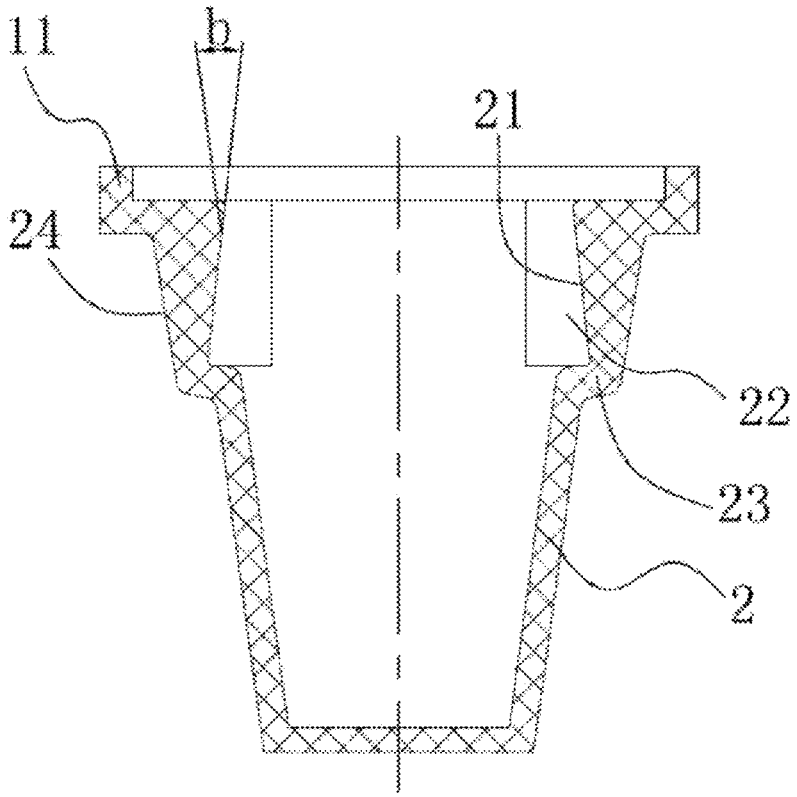
FIG. 5 is a schematic structural diagram provided by a second embodiment of the present invention.

The present embodiment is basically as the same as the structure and principle of the first embodiment, which will not be described in detail herein for brevity. The difference lies in that:

As shown in FIG. 5, at least two separation spaces 22 are provided and it shows two symmetrically arranged separation steps. The outer diameter of the protruding shoulder 23 is larger than the distance between the upper ends of two symmetrically arranged separation steps. The separation steps are of arc shape. Secondly, a second included angle b is formed between the sidewall of the separation steps and the inner wall of the pulp container 2, and the second included angle b is 0°<the second included angle b<180°.

In the above-described pulp molding negative angle container, the longitudinal section thickness of the open end of the pulp container increases gradually from bottom to top. The protruding shoulder is an annular protruding shoulder with an annular conical surface that slopes inwards from top to bottom at the protruding shoulder outer wall.

Third Embodiment

Figure 6:
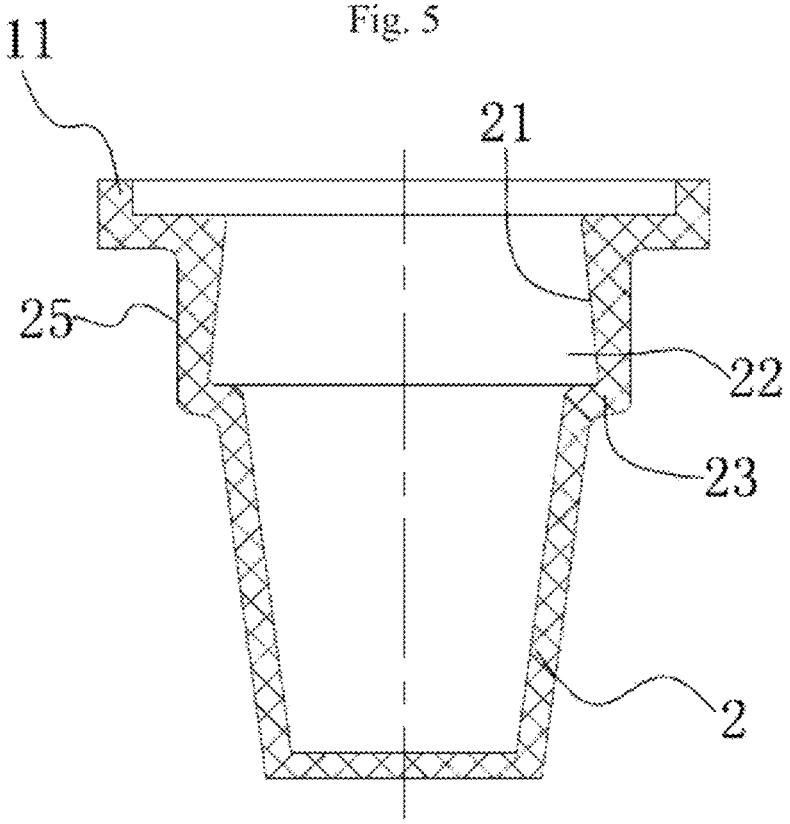
FIG. 6 is a schematic structural diagram provided by a third embodiment of the present invention.

The present embodiment is basically as the same as the structure and principle of the first embodiment, which will not be described in detail herein for brevity. The difference lies in that:

As shown in FIG. 6, the outer wall of the protruding shoulder 23 has a vertically disposed straight surface 25.

In the above pulp molding negative angle container, the axis line of the conical separation countersink coincides with the axis line of the pulp container. The separation steps are arranged symmetrically with respect to the axis line of the pulp container.

In the above pulp molding negative angle container, the outer edge of the pulp panel has an annular skirt folded upwards.

In the above pulp molding negative angle container, a third included angle is formed between the inner wall of the conical separation countersink and the straight surface, and the angle of the third included angle is 0°<the third included angle <180°.

In the above pulp molding negative angle container, the bottom of the inner wall of the pulp container has several circumferentially distributed convex parts protruding inwards, and the bottom of the outer wall of the pulp container has concavity parts corresponding to the convex parts.

Although certain inventive embodiments of the present disclosure have been specifically described, the present disclosure is not to be construed as being limited thereto. Various changes or modifications may be made to the present disclosure beyond departing from the scope and spirit of the present disclosure.

We claim:

1. A pulp molding container comprising:

a pulp panel;

at least one conical pulp container having an open upper end attached to the pulp panel wherein:

an inner wall of the open end of the pulp container has a separation space inclined downwards and set outwards;

a protruding shoulder is provided on the outer wall of the open end of the pulp container, wherein the outer diameter of the protruding shoulder is larger than the inner diameter of a hole on the open end; and when two pulp containers are nested over each other, the protruding shoulder is placed on the upper hole of the open end and a separation gap is formed between the separation space on one pulp container and the outer wall on the other pulp container.

2. The pulp molding container according to claim 1, wherein at least two separation spaces are provided, showing two symmetrically arranged separation steps; and the outer diameter of the protruding shoulder is larger than the distance between the upper ends of two symmetrically arranged separation steps.

3. The pulp molding container according to claim 2, wherein a longitudinal section thickness of the open end of the pulp container increases gradually from bottom to top.

4. The pulp molding container according to claim 2, wherein the protruding shoulder is an annular protruding shoulder; an annular conical surface is provided on the outer wall of the protruding shoulder, inclining inwards from top to bottom; or a vertically disposed straight surface is provided on the outer wall of the protruding shoulder.

5. The pulp molding container according to claim 2, wherein the outer edge of the pulp panel has an annular skirt folded upwards.

6. The pulp molding container according to claim 2, wherein a second included angle (b) is formed between the sidewall of the separation steps and the inner wall of the pulp container, and the second included angle (b) is 0°<the second included angle (b)<180°.

7. The pulp molding container according to claim 1, wherein a longitudinal section thickness of the open end of the pulp container increases gradually from bottom to top.

8. The pulp molding container according to claim 7, wherein a longitudinal section thickness of the open end of the pulp container increases gradually from bottom to top.

9. The pulp molding container according to claim 7, wherein the protruding shoulder is an annular protruding shoulder; an annular conical surface is provided on the outer wall of the protruding shoulder, inclining inwards from top to bottom; or a vertically disposed straight surface is provided on the outer wall of the protruding shoulder.

10. The pulp molding container according to claim 7, wherein the outer edge of the pulp panel has an annular skirt folded upwards.

11. The pulp molding container according to claim 7, wherein a first included angle (a) is formed between the hole wall of the conical separation countersink and the inner wall of the pulp container, wherein the first included angle (a) is: 0°<the first included angle (a)<180°.

12. The pulp molding container according to claim 1, wherein the outer edge of the pulp panel has an annular skirt folded upwards.

* * * * *